US008253682B2

(12) United States Patent
Feng

(10) Patent No.: US 8,253,682 B2
(45) Date of Patent: Aug. 28, 2012

(54) BACKLIGHT DRIVING CIRCUIT CAPABLE OF ADJUSTING BRIGHTNESS OF A LAMP NOT ONLY ACCORDING TO AN ADJUSTMENT OF USER, BUT ALSO ACCORDING TO GRAY LEVEL VOLTAGES OF A DISPLAY IMAGE

(75) Inventor: Sha Feng, Shenzhen (CN)

(73) Assignees: Innocom Technology (Shenzhen) Co., Ltd., Shenzhen (CN); Chimei Innolux Corporation, Miaoli County (TW)

( * ) Notice: Subject to any disclaimer, the term of this patent is extended or adjusted under 35 U.S.C. 154(b) by 891 days.

(21) Appl. No.: 12/283,825

(22) Filed: Sep. 15, 2008

(65) Prior Publication Data

US 2009/0073110 A1 Mar. 19, 2009

(30) Foreign Application Priority Data

Sep. 14, 2007 (CN) ..... 2007 1 0077107

(51) Int. Cl.
*G09G 3/36* (2006.01)

(52) U.S. Cl. ..... 345/102

(58) Field of Classification Search ..... 345/102
See application file for complete search history.

(56) References Cited

U.S. PATENT DOCUMENTS

| | | | | |
|---|---|---|---|---|
| 5,844,540 | A * | 12/1998 | Terasaki | 345/102 |
| 6,466,196 | B1 * | 10/2002 | Isogawa et al. | 345/102 |
| 6,690,121 | B1 | 2/2004 | Weindorf | |
| 6,750,842 | B2 * | 6/2004 | Yu | 345/102 |
| 7,248,245 | B2 * | 7/2007 | Adachi et al. | 345/102 |
| 7,391,163 | B2 * | 6/2008 | Jang | 315/308 |
| 7,405,721 | B2 * | 7/2008 | Tachibana | 345/102 |
| 7,667,415 | B2 * | 2/2010 | Hatano et al. | 345/102 |
| 7,773,065 | B2 * | 8/2010 | Kumamoto | 345/102 |
| 7,835,164 | B2 * | 11/2010 | Lyle, Jr. | 363/95 |
| 7,944,652 | B2 * | 5/2011 | Fukumoto | 315/276 |
| 2002/0163489 | A1 * | 11/2002 | Kuo et al. | 345/89 |
| 2003/0076316 | A1 * | 4/2003 | Kang | 345/212 |
| 2005/0243580 | A1 * | 11/2005 | Lyle, Jr. | 363/16 |
| 2006/0158132 | A1 * | 7/2006 | Jang | 315/209 R |
| 2006/0170373 | A1 * | 8/2006 | Yang | 315/209 R |
| 2007/0115302 | A1 | 5/2007 | Huang | |
| 2007/0132712 | A1 | 6/2007 | Song | |
| 2007/0222739 | A1 * | 9/2007 | Yu et al. | 345/102 |
| 2008/0074381 | A1 * | 3/2008 | Kumamoto | 345/102 |
| 2008/0117162 | A1 * | 5/2008 | Song et al. | 345/102 |
| 2009/0015179 | A1 * | 1/2009 | Hatano et al. | 315/307 |

FOREIGN PATENT DOCUMENTS

| | | | |
|---|---|---|---|
| CN | 1983368 | A | 6/2007 |
| WO | WO 2006080219 | A1 * | 8/2006 |

* cited by examiner

*Primary Examiner* — Adam J Snyder
(74) *Attorney, Agent, or Firm* — WPAT, PC; Justin King

(57) ABSTRACT

A backlight driving circuit includes a brightness controller, a timing controller, and a logic calculation circuit. The brightness controller is configured to provide a first control signal to the logic calculation circuit, the timing controller is configured to provide a second control signal to the logic calculation circuit, and the logic calculation circuit is configured to select the first or second control signal to adjust a brightness of a lamp.

10 Claims, 2 Drawing Sheets

BACKLIGHT DRIVING CIRCUIT CAPABLE OF ADJUSTING BRIGHTNESS OF A LAMP NOT ONLY ACCORDING TO AN ADJUSTMENT OF USER, BUT ALSO ACCORDING TO GRAY LEVEL VOLTAGES OF A DISPLAY IMAGE

FIELD OF THE INVENTION

The present disclosure relates to backlight driving circuits, and more particularly to a backlight driving circuit for adjusting brightness of a lamp used in a backlight module of a liquid crystal display (LCD) device.

BACKGROUND

LCD devices are commonly used as displays for compact electronic apparatuses, because they provide good quality images with little power consumption and are very thin. The liquid crystal material in an LCD device does not emit light. The liquid crystal material must be lit by a light source to clearly and sharply display text and images. Thus, a backlight module is generally needed for an LCD device. The backlight module usually uses cold cathode fluorescent lamps (CCFLs) as light sources. Due to the lamps needed to be driven by an alternating current high voltage, the backlight module using the lamps as its light source needs a backlight driving circuit which can convert a direct current voltage to an alternating current voltage to drive the lamps.

Referring to FIG. 5, one such backlight driving circuit 100 includes a brightness controller 110, a pulse width modulation (PWM) circuit 150, an inverter 160, and a lamp 170 electrically connected in series. The backlight driving circuit 100 is used to drive the lamp 170 and adjust a brightness thereof.

When a user sends a brightness adjusting signal to the brightness controller 110 via on-screen display keys (not shown) disposed on a frame of an LCD device using the backlight driving circuit 100, the brightness controller 110 outputs a control signal to the PWM circuit 150. The PWM circuit 150 receives the control signal and outputs a pulse signal to the inverter 160. The pulse signal has a duty ratio according to the control signal. The inverter 160 receives the pulse signal and generates an alternating current voltage to drive the lamp 170. The brightness of the lamp 170 changes according to the duty ratio. The larger the duty ratio is, the brighter the lamp 170 is.

For energy saving and contrast improving, new technology for adjusting the brightness of backlight has been developed, such as dynamic backlight control (DBC) technology. By using the DBC technology, the brightness of backlight can be adjusted dynamically according to display images. The DBC technology is desired to be employed to reduce backlight power consumption while maintaining image fidelity and quality. However, the backlight driving circuit 100 can adjust the brightness of the lamp 170 only by the user via the brightness controller 110. Thus, the backlight driving circuit 100 lacks compatibility with other backlight control technology.

Therefore, an improved backlight driving circuit is desired to overcome the above-described deficiencies.

SUMMARY

An aspect of the invention relates to a backlight driving circuit including a brightness controller, a timing controller, and a logic calculation circuit. The brightness controller is configured to provide a first control signal to the logic calculation circuit, the timing controller is configured to provide a second control signal to the logic calculation circuit, and the logic calculation circuit is configured to select the first or second control signal to adjust a brightness of a lamp.

Other novel features and advantages will become more apparent from the following detailed description and when taken in conjunction with the accompanying drawings.

BRIEF DESCRIPTION OF THE DRAWINGS

The components in the drawings are not necessarily drawn to scale, the emphasis instead being placed upon clearly illustrating the principles of at least one embodiment. In the drawings, like reference numerals designate corresponding parts throughout the various views.

DETAILED DESCRIPTION

Reference will now be made to the drawings to describe the embodiments in detail.

Figure 1:
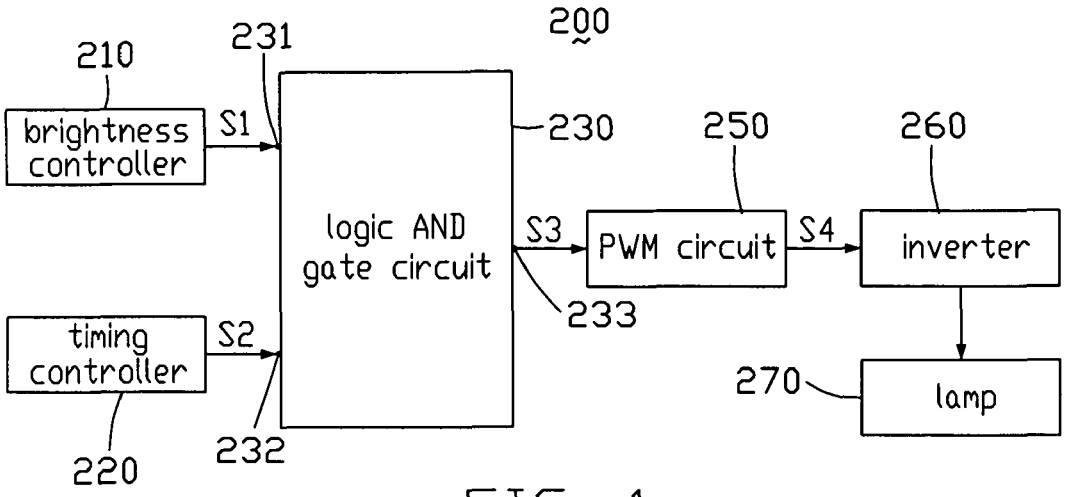
FIG. 1 is a block diagram of a first embodiment of a backlight driving circuit of the present disclosure.

Referring to FIG. 1, a first embodiment of a backlight driving circuit 200 which can be used in an LCD device includes a brightness controller 210, a timing controller 220, a logic AND gate circuit 230, a PWM circuit 250, an inverter 260, and a lamp 270. The logic AND gate circuit 230 includes a first input terminal 231 and a second input terminal 232 and an output terminal 233. The first and second input terminals 231, 232 are electrically connected to the brightness controller 210 and the timing controller 220, respectively. The output terminal 233, the PWM circuit 250, the inverter 260, and the lamp 270 are electrically connected in series.

When the backlight driving circuit 200 operates, a user may send a brightness adjusting signal to the brightness controller 210 via on-screen display keys (not shown) disposed on a frame of the LCD device. Then, the brightness controller 210 outputs a first control signal S1 to the logic AND gate circuit 230 via the first input terminal 231. A duty ratio of the first control signal S1 changes according to the brightness adjusting signal, and a frequency f1 of the first control signal S1 can be, for example, 300 Hz. The timing controller 220 outputs a second control signal S2 to the logic AND gate circuit 230 via the second input terminal 232 according to a gray level display image. A frequency f2 of the second control signal S2 can, for example, be 3000 Hz. In this embodiment, the frequency f1 of the first control signal S1 is less than the frequency f2 of the second control signal S2. The logic AND gate circuit 230 receives the first and second control signals S1, S2 and outputs a third control signal S3 to the PWM circuit 250. The third control signal S3 is formed by calculating the first and second control signals S1, S2 via the logic AND gate circuit 230.

Figure 2:
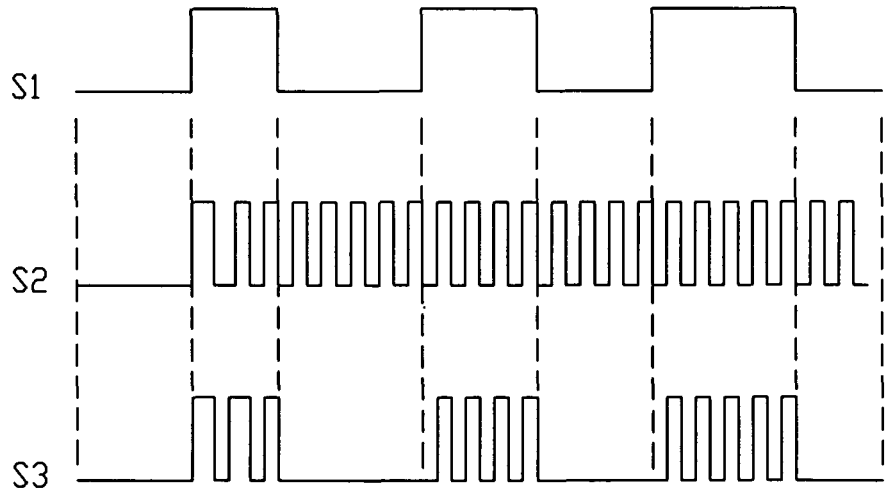
FIG. 2 is a waveform diagram of a first control signal, a second control signal, and a third control signal of the backlight driving circuit of FIG. 1.

Referring to FIG. 2, a waveform diagram of the first control signal S1, the second control signal S2, and the third control signal S3 is shown. When the first control signal S1 received by the logic AND gate circuit 230 is at a high level (e.g., corresponding to a Boolean "1" for example), a waveform of the third control signal S3 outputted by the logic AND gate circuit 230 may be substantially the same as the second control signal S2 received by the logic AND gate circuit 230. When the first control signal S1 received by the logic AND gate circuit 230 is at a low level (e.g., corresponding to a Boolean "0" for example), a waveform of the third control signal S3 outputted by the logic AND gate circuit 230 may be substantially the same as the first control signal S1 received by the logic AND gate circuit 230.

While having received the third control signal S3 outputted by the logic AND gate circuit 230, the PWM circuit 250 generates a pulse signal S4 according to the third control signal S3 and outputs the pulse signal S4 to the inverter 260. The inverter 260 receives the pulse signal S4 and generates an alternating current voltage to drive the lamp 270. The brightness of the lamp 270 changes according to a duty ratio of the pulse signal S4. The larger the duty ratio is, the brighter the lamp 270 is.

The backlight driving circuit 200 uses the logic AND gate circuit 230 to select the first control signal S1 outputted by the brightness controller 210 or the second control signal S2 outputted by the timing controller 220 to adjust the brightness of the lamp 270. Therefore, the backlight driving circuit 200 can adjust the brightness of the lamp 270 according to the gray level display images based on a brightness adjustment of the user, and thereby having good compatibility.

Figure 3:
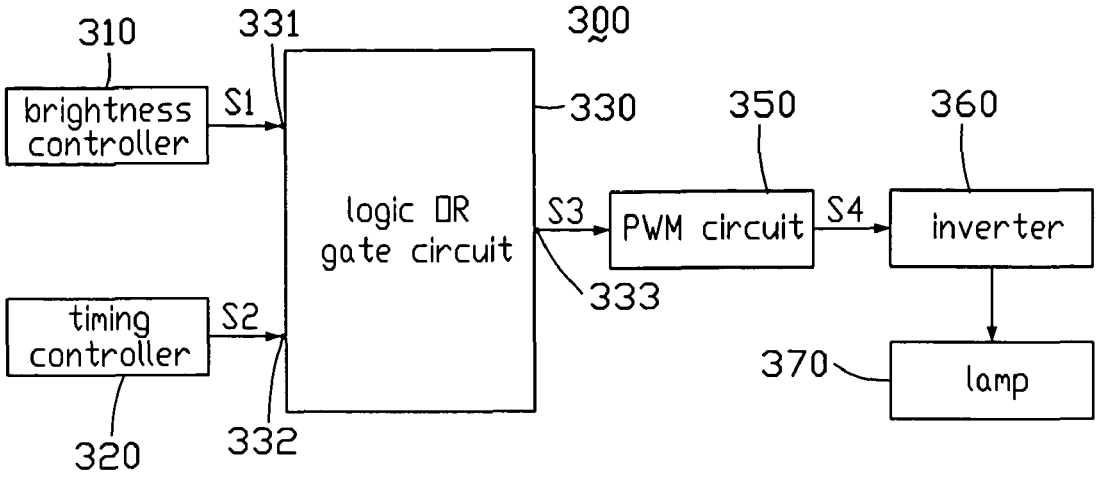
FIG. 3 is a block diagram of a second embodiment of a backlight driving circuit of the present disclosure.

Referring to FIG. 3, a second embodiment of a backlight driving circuit 300 which can be used in an LCD device includes a brightness controller 310, a timing controller 320, a logic OR gate circuit 330, a PWM circuit 350, an inverter 360, and a lamp 370. The logic OR gate circuit 330 includes a first input terminal 331, a second input terminal 332, and an output terminal 333. The first and second input terminals 331, 332 are electrically connected to the brightness controller 310 and the timing controller 320, respectively. The output terminal 333, the PWM circuit 350, the inverter 360, and the lamp 370 are electrically connected in series.

When the backlight driving circuit 300 operates, a user may send a brightness adjusting signal to the brightness controller 310 of the backlight driving circuit 300 via on-screen display keys (not shown) disposed on a frame of the LCD device. Then the brightness controller 310 outputs a first control signal S1 to the logic OR gate circuit 330 via the first input terminal 331. A duty ratio of the first control signal S1 changes according to the brightness adjusting signal, and a frequency f1 of the first control signal S1 can, for example, be 300 Hz. The timing controller 320 outputs a second control signal S2 to the logic OR gate circuit 330 via the second input terminal 332 according to a gray level display image. A frequency f2 of the second control signal S2 can, for example, be 3000 Hz. In this embodiment, the frequency f1 of the first control signal S1 is less than the frequency f2 of the second control signal S2. The logic OR gate circuit 330 receives the first and second control signals S1, S2 and outputs a third control signal S3 to the PWM circuit 350. The third control signal S3 is formed by calculating the first and second control signals S1, S2 via the logic OR gate circuit 330.

Figure 4:
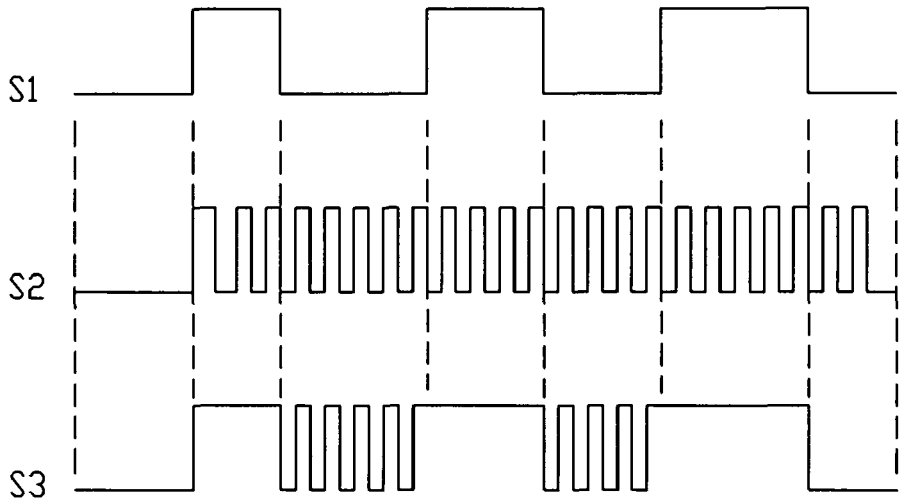
FIG. 4 is a waveform diagram of a first control signal, a second control signal, and a third control signal of the backlight driving circuit of FIG. 3.
Figure 5:
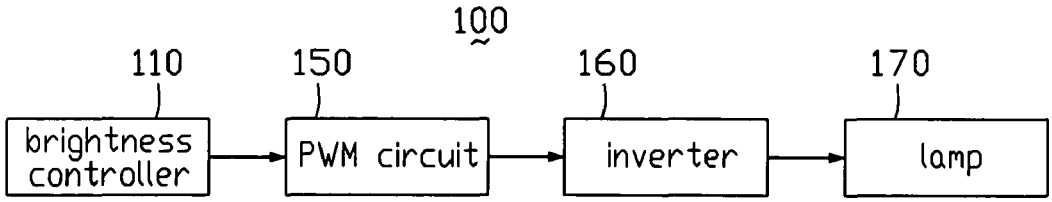
FIG. 5 (RELATED ART)
FIG. 5 is a block diagram of a typical backlight driving circuit.

Referring to FIG. 4, a waveform diagram of the first control signal S1, the second control signal S2, and the third control signal S3 is shown. When the first control signal S1 received by the logic OR gate circuit 330 is at a high level (e.g., corresponding to a Boolean "1" for example), a waveform of the third control signal S3 outputted by the logic OR gate circuit 330 may be substantially the same as the first control signal S1 received by the logic OR gate circuit 330. When the first control signal S1 received by the logic OR gate circuit 330 is at a low level (e.g., corresponding to a Boolean "0" for example), a waveform of the third control signal S3 outputted by the logic OR gate circuit 330 may be substantially the same as the second control signal S2 received by the logic OR gate circuit 330.

While having received the third control signal S3 outputted by the logic OR gate circuit 330, the PWM circuit 350 generates a pulse signal S4 according to the third control signal S3 and outputs the pulse signal S4 to the inverter 360. The inverter 360 receives the pulse signal S4 and generates an alternating current voltage to drive the lamp 370. The brightness of the lamp 370 changes according to a duty ratio of the pulse signal S4.

The backlight driving circuit 300 uses the logic OR gate circuit 330 to select the first control signal S1 outputted by the brightness controller 310 or the second control signal S2 outputted by the timing controller 320 to adjust the brightness of the lamp 370. Therefore, the backlight driving circuit 300 can adjust the brightness of the lamp 370 according to the gray level display images based on a brightness adjustment of the user, and thereby having good compatibility.

In alternative embodiments, the backlight driving circuits of this invention are not limited to use the logic AND gate circuit 230 or the logic OR gate circuit 330, other logic calculation circuits which can calculate two or more signals and select one or more to output can be used. The logic calculation circuit can be integrated in the PWM circuit, the brightness controller, or the timing controller.

It is to be understood that even though numerous characteristics and advantages of the present embodiments have been set forth in the foregoing description with details of the structures and functions of the embodiments, the disclosure is illustrative only, and changes made in detail, especially in matters of shape, size, and arrangement of parts, within the principles of the embodiments, to the full extent indicated by the broad general meaning of the terms in which the appended claims are expressed.

What is claimed is:

1. A backlight driving circuit, comprising:

a brightness controller configured to generate a first control signal according to a brightness adjusting signal which is defined by a predetermined parameter, the brightness adjusting signal being variable according to an OSD adjustment operation from a user, a duty ratio of the first control signal being variable according to a variance of the brightness adjusting signal;

a timing controller configured to generate a second control signal according to a brightness component of image data of a video image to be displayed, a duty ratio of the second control signal being variable according to a variance of the brightness component;

a logic AND gate circuit configured to directly receive the first control signal from the brightness controller and the second control signal from the timing controller, perform the logical AND operation on the first control signal and the second control signal, and generate a composite signal via the logical AND operation;

a pulse width modulation (PWM) circuit configured to receive the composite signal from the logic AND gate circuit, and generate a pulse signal according to the composite signal; and an inverter configured to receive the pulse signal from the PWM circuit, generate a driving voltage according to the pulse signal, and adjust the brightness of a lamp by use of the driving voltage;

wherein a frequency of the first control signal is less than a frequency of the second control signal.

2. The backlight driving circuit of claim 1, wherein the logic AND gate circuit receives the first and second control signals simultaneously.

3. A backlight driving circuit, comprising:

a brightness controller configured to generate a first control signal according to a brightness adjusting signal which is defined by a predetermined parameter, the brightness adjusting signal being variable according to an OSD adjustment operation from a user, a duty ratio of the first control signal being variable according to a variance of the brightness adjusting signal;

a timing controller configured to generate a second control signal according to a brightness component of image data of a video image to be displayed, a duty ratio of the second control signal being variable according to a variance of the brightness component;

a logic OR gate circuit configured to directly receive the first control signal from the brightness controller and the second control signal from the timing controller, perform the logical OR operation on the first control signal and the second control signal, and generate a composite signal via the logical OR operation;

a pulse width modulation (PWM) circuit configured to receive the composite signal from the logic OR gate circuit, and generate a pulse signal according to the composite signal; and an inverter configured to receive the pulse signal from the PWM circuit, generate a driving voltage according to the pulse signal, and adjust the brightness of a lamp by use of the driving voltage;

wherein a frequency of the first control signal is less than a frequency of the second control signal.

4. A backlight driving circuit, comprising:

a brightness controller configured to generate a first control signal according to a brightness adjusting signal which is defined by a predetermined parameter, the brightness adjusting signal being variable according to an OSD adjustment operation from a user, a duty ratio of the first control signal being variable according to a variance of the brightness adjusting signal;

a timing controller configured to generate a second control signal according to a brightness component of image data of a video image to be displayed, a duty ratio of the second control signal being variable according to a variance of the brightness component;

a logic calculation circuit configured to receive the first control signal from the brightness controller and the second control signal from the timing controller, logically combines the first control signal with the second control signal, and generate a composite signal via a combination result;

a pulse width modulation (PWM) circuit configured to receive the composite signal from the logic calculation circuit, and generate a pulse signal according to the composite signal; and an inverter configured to receive the pulse signal from the PWM circuit, generate a driving voltage according to the pulse signal, and adjust the brightness of a lamp by use of the driving voltage.

5. The backlight driving circuit of claim 4, wherein the logic calculation circuit directly receives the first control signal from the brightness controller and the second control signal from the timing controller.

6. The backlight driving circuit of claim 5, wherein when the first control signal received by the logic calculation circuit is at high level, the logic calculation circuit outputs the first control signal, when the first control signal received by the logic calculation circuit is at low level, the logic calculation circuit outputs the second control signal, the first and second control signals outputted from the logic calculation circuit constitute the composite signal.

7. The backlight driving circuit of claim 6, wherein when the brightness component of image data of the video image to be displayed becomes low, the second control signal outputted from the logic calculation circuit adjusts the brightness of the lamp to be low, and when the brightness component of image data of the video image to be displayed becomes high, the second control signal outputted from the logic calculation circuit adjusts the brightness of the lamp to be high.

8. The backlight driving circuit of claim 7, wherein a frequency of the first control signal is less than a frequency of the second control signal.

9. The backlight driving circuit of claim 4, wherein the logic calculation circuit comprises a logic AND gate circuit, the logic AND gate circuit directly receives the first control signal from the brightness controller and the second control signal from the timing controller, performs the logical AND operation on the first control signal and the second control signal, and generate the composite signal via the logical AND operation.

10. The backlight driving circuit of claim 8, wherein the logic calculation circuit comprises a logic OR gate circuit, the logic OR gate circuit directly receives the first control signal from the brightness controller and the second control signal from the timing controller, performs the logical OR operation on the first control signal and the second control signal, and generate the composite signal via the logical OR operation.

* * * * *